US009572465B2

(12) United States Patent
Tomasiak

(10) Patent No.: US 9,572,465 B2
(45) **Date of Patent: *Feb. 21, 2017**

(54) SLIDE OUT DRUM WITH FILTER FOR A WET/DRY VACUUM APPLIANCE

(71) Applicant: Emerson Electric Co., St. Louis, MO (US)

(72) Inventor: Mark J. Tomasiak, St. Peters, MO (US)

(73) Assignee: EMERSON ELECTRIC CO., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/478,566

(22) Filed: Sep. 5, 2014

(65) Prior Publication Data

US 2014/0373306 A1 Dec. 25, 2014

Related U.S. Application Data

(63) Continuation-in-part of application No. 12/633,791, filed on Dec. 8, 2009, now Pat. No. 8,973,196.
(Continued)

(51) Int. Cl.

| | |
|---|---|
| ***A47L 7/00*** | (2006.01) |
| ***A47L 9/10*** | (2006.01) |
| ***A47L 9/12*** | (2006.01) |
| ***A47L 5/36*** | (2006.01) |
| ***A47L 9/00*** | (2006.01) |

(52) U.S. Cl.

CPC ..... *A47L 7/0004* (2013.01); *A47L 5/365* (2013.01); *A47L 7/0019* (2013.01); *A47L 7/0028* (2013.01); *A47L 7/0038* (2013.01); *A47L 7/0042* (2013.01); *A47L 9/009* (2013.01); *A47L 9/106* (2013.01); *A47L 9/127* (2013.01); *Y10T 29/49723* (2015.01)

(58) Field of Classification Search

CPC .. A47L 11/4013; A47L 11/4019; A47L 5/365; A47L 7/0004; A47L 7/0019; A47L 7/0028; A47L 7/0038; A47L 7/0042; A47L 9/0018; A47L 9/0027; A47L 9/009; A47L 9/106; A47L 9/127; A47L 9/1691

See application file for complete search history.

(56) References Cited

U.S. PATENT DOCUMENTS 2,819,485 A 1/1958 Sparklin
2,876,484 A 3/1959 Wells
(Continued)

FOREIGN PATENT DOCUMENTS

KR 20-0205475 12/2000

*Primary Examiner* — Todd E Manahan
*Assistant Examiner* — Jennifer Gill
(74) *Attorney, Agent, or Firm* — Sutton McAughan Deaver PLLC

(57) ABSTRACT

A wet and dry vacuum cleaner system is disclosed, wherein the system includes a debris container having an inlet and outlet, a filter support having a filter and being adapted to situate at least a portion of the filter within the container and intermediate between the inlet and outlet, a vacuum unit adapted to be coupled to the container, and a housing. A wet/dry vacuum appliance system is also disclosed, which includes means for housing a vacuum unit, means for slidably receiving a debris container, and means for releasably holding the container in sealed engagement with the vacuum unit. In addition, methods of removing debris from such a vacuum cleaner and vacuum appliance systems are described.

19 Claims, 12 Drawing Sheets

Related U.S. Application Data

(60) Provisional application No. 61/120,560, filed on Dec. 8, 2008.

(56) References Cited

U.S. PATENT DOCUMENTS 3,180,071 A 4/1965 Nolte
D208,398 S 8/1967 Otto
3,434,582 A 3/1969 Grave
3,664,716 A * 5/1972 Johnson ..... A47B 88/14 312/334.19
3,954,315 A * 5/1976 Sanden ..... A47B 88/0477 312/333
D253,472 S 11/1979 Cannon et al.
4,179,768 A * 12/1979 Sawyer ..... A47L 7/0019 15/352
4,199,200 A * 4/1980 Livingston ..... A47B 88/0407 312/334.18
D255,357 S 6/1980 Brooks et al.
D292,336 S 10/1987 Kieft et al.
4,705,547 A * 11/1987 Rotola, Jr. ..... A47L 9/1427 15/327.7
4,786,333 A 11/1988 Kaiser
4,841,595 A * 6/1989 Wiese ..... A47L 7/0028 137/205
4,888,849 A 12/1989 Hult et al.
4,910,823 A 3/1990 Silverman et al.
4,934,017 A * 6/1990 Kent ..... A47L 5/365 15/321
4,983,221 A 1/1991 Kaiser
D318,543 S 7/1991 Shero
5,089,037 A * 2/1992 Marsolais ..... A47L 5/36 15/323
5,178,655 A 1/1993 Sassier
5,244,265 A 9/1993 Chiang
D343,706 S 1/1994 Gurstein
5,301,386 A 4/1994 Thomas et al.
5,313,686 A 5/1994 Berfield
5,349,714 A 9/1994 Korbonski et al.
5,394,585 A 3/1995 Connelly
D362,091 S 9/1995 Tomasiak et al.
5,471,726 A 12/1995 Kaiser
5,496,412 A 3/1996 Ahmad
5,528,794 A 6/1996 Tomasiak
5,570,489 A * 11/1996 Lee ..... A47L 7/0042 15/327.2
5,598,605 A 2/1997 Tomasiak
5,611,107 A 3/1997 Tomasiak et al.
5,682,638 A 11/1997 Kaiser
D403,827 S 1/1999 Smoker
D411,784 S 7/1999 Houry
5,946,768 A * 9/1999 Kelly ..... A47L 5/28 15/310
5,954,863 A * 9/1999 Loveless ..... A47L 5/365 15/353
D420,473 S 2/2000 Shero
D422,386 S 4/2000 Jaros et al.
6,113,663 A 9/2000 Liu
6,129,432 A * 10/2000 Pollard ..... A47B 67/04 312/330.1
6,176,559 B1 1/2001 Tiramani et al.
D437,484 S 2/2001 Tiramani et al.
D444,279 S 6/2001 Kristiansen et al.
D451,256 S 11/2001 Armanno, Sr.
6,347,847 B1 2/2002 Tiramani et al.
6,574,819 B1 6/2003 Ratcliffe
6,601,930 B2 8/2003 Tiramani et al.
6,934,994 B2 8/2005 Oh et al.
7,024,716 B2 4/2006 Murakami
D528,718 S 9/2006 Tomasiak et al.
7,152,272 B2 12/2006 Rukavina et al.
7,185,389 B2 3/2007 Thomason et al.
7,318,848 B2 1/2008 Lee
D565,269 S 3/2008 Tomasiak et al.
7,552,506 B2 * 6/2009 Lee ..... A47L 9/127 15/347
D596,367 S 7/2009 Katz
7,571,512 B2 8/2009 Park et al.
7,637,973 B2 * 12/2009 Oh ..... A47L 9/00 15/328
7,694,384 B2 4/2010 Park et al.
8,615,845 B2 12/2013 Norell et al.
2002/0030425 A1 3/2002 Tiramani et al.
2002/0092123 A1 7/2002 Stephens et al.
2002/0152577 A1 10/2002 Moore et al.
2003/0213090 A1 11/2003 Holsten et al.
2004/0088817 A1 5/2004 Cochran et al.
2004/0093684 A1 * 5/2004 Park ..... A47L 9/1666 15/327.1
2004/0200028 A1 10/2004 Oh et al.
2004/0211025 A1 10/2004 Jung et al.
2005/0011037 A1 1/2005 Zhao et al.
2006/0123588 A1 * 6/2006 Kaiser ..... A47L 9/00 15/352
2006/0277712 A1 12/2006 Kim et al.
2007/0209334 A1 9/2007 Conrad
2009/0083932 A1 4/2009 Henderson
2009/0100630 A1 4/2009 Kim et al.
2010/0017998 A1 1/2010 McCambridge et al.
2010/0071152 A1 3/2010 Cho et al.
2010/0313912 A1 12/2010 Han et al.

* cited by examiner

SLIDE OUT DRUM WITH FILTER FOR A WET/DRY VACUUM APPLIANCE

CROSS REFERENCE TO RELATED APPLICATIONS

The present application is a Continuation-In-Part of, and claims priority to, U.S. Provisional patent application Ser. No. 12/633,791 now U.S. Pat. No. 8,973,196, filed Dec. 8, 2009, which claims priority to U.S. Provisional Patent Application Ser. No. 61/120,560 filed Dec. 8, 2008, the contents of each of which are incorporated herein by reference in their entirety.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The inventions disclosed and taught herein relate generally to wet and dry vacuum cleaners, and more specifically relate to removable drums associated with wet/dry vacuum cleaners, and the removal of such drums containing debris from a wet/dry vacuum cleaner with little or no dirtying or contamination of the surrounding area.

Description of the Related Art

A number of wet and dry vacuum cleaners, or wet/dry vacs, are known in the art. Typically, these vacuum cleaners suck air, liquid and/or debris through a flexible hose and into a container or drum, where the air then flows through a filter and out of the container, leaving the debris inside the container and/or embedded in the filter. Occasionally, after a period of such use, the container must be emptied and the filter cleaned so as to avoid damage to the efficiency and/or operation of the vacuum cleaner. However, the removal of the filter and/or drum from current wet/dry vacuum appliances may be a tedious and messy task. For instance, many wet/dry vacs require that the vacuum unit, or powerhead, be removed from the container and inverted in order for the filter to be cleaned or replaced. This often results in dirt and debris becoming dislodged from the powerhead or filter and making its way onto the floor or other surroundings, including the user in some cases.

The inventions disclosed and taught herein are directed to vacuum appliance systems having filter assemblies comprising a filter support, wherein the filter support assembly allows for debris to be more easily removed from the vacuum assembly without dislodging the debris from the filter prematurely and/or dirtying the surrounding area.

BRIEF SUMMARY OF THE INVENTION

Vacuum appliance systems and assemblies for enhanced debris removal from a vacuum appliance are disclosed herein, wherein a drum and associated filter assembly of a wet/dry vacuum appliance which is full of debris may be removed from the vacuum appliance without having to separately remove or lift the vacuum powerhead assembly, allowing for the user of the wet/dry vacuum appliance to remove the drum full of debris, along with dirty filter, to a place where it can be emptied without the user having to touch the debris and without having to clean up excess debris from when the user had to remove the filter from the powerhead.

In accordance with a first embodiment of the present disclosure, a wet and dry vacuum cleaner system is described, wherein the system comprises a container for receiving debris, a filter and a filter support assembly, the container being of any shape and comprising an air inlet and an air outlet. The system may further include a filter and a filter support, wherein the support may be removably coupled to the container and/or another component of the system. The support may be adapted to situate the filter at least partially within the container, such as intermediate between the air inlet and the air outlet. The system may also include a vacuum unit, such as a powerhead, having a vacuum inlet and a vacuum outlet. The vacuum unit may be coupled to the container and/or another component of the system, such as to allow fluid communication between the container and the vacuum unit. The system may include a housing adapted to house one or more components of the system, in whole or in part. For example, the container may be coupled, removably or otherwise, in a desired position relative to one or more other components of the system, such as to be in communication with the vacuum unit.

In accordance with a further embodiment of the present disclosure, a method of removing debris from a vacuum cleaner system in accordance with the present invention is also disclosed. The method may include decoupling the container from the vacuum unit, such as to allow the container to be separated or removed from the system. The method may further include decoupling the container from the housing or from, for example, one or more other components of the system. The filter support and/or filter may be decoupled from the container or otherwise removed from the system, such as to facilitate cleaning or removing debris from the filter or container.

In accordance with certain embodiments of the present disclosure, a wet and dry vacuum cleaner system for use herein may include means for housing a vacuum unit, such as a vacuum unit including a vacuum inlet having one or more sealing surfaces thereon. The system may further include means for receiving a debris container, the container having sealing means adapted to sealingly engage one or more sealing surfaces of the vacuum unit. The system may also include means for positioning the sealing means of the container in close proximity to the sealing surfaces of the vacuum unit and/or means for releasably holding the container in sealed engagement with the vacuum unit.

In further embodiments of the present disclosure, a wet and dry vacuum cleaner system for use herein may include a housing, which may have one or more panels, such as side panels, and a vacuum unit, which may have an inlet and outlet. The vacuum unit may be coupled, removably or otherwise, to one or more of the side panels, such as to support or hold the vacuum unit in place. The system may include a container, which may be substantially rectangular in shape, round, or any shape, and which may include one or more air inlets. The container may further include one or more air outlets, such as an open top or, as another example, a more restricted outlet, such as an outlet defined by one or more other components of the system, or portions thereof, singularly or in combination. The container may be coupled with one or more other components of the system, removably or otherwise. For example, the container may be coupled relative to the vacuum unit such as to allow the vacuum inlet to communicate with at least a portion of the interior of the container or air exiting therefrom. The system may include a filter support, which may or may not have a filter coupled thereto, such as a support adapted to couple at least partially within an airflow path. For example, the support may be removably coupled between the inside of the container and the vacuum inlet, such as to allow air traveling from the container to the vacuum unit to pass proximate to or through the support and/or filter.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1:
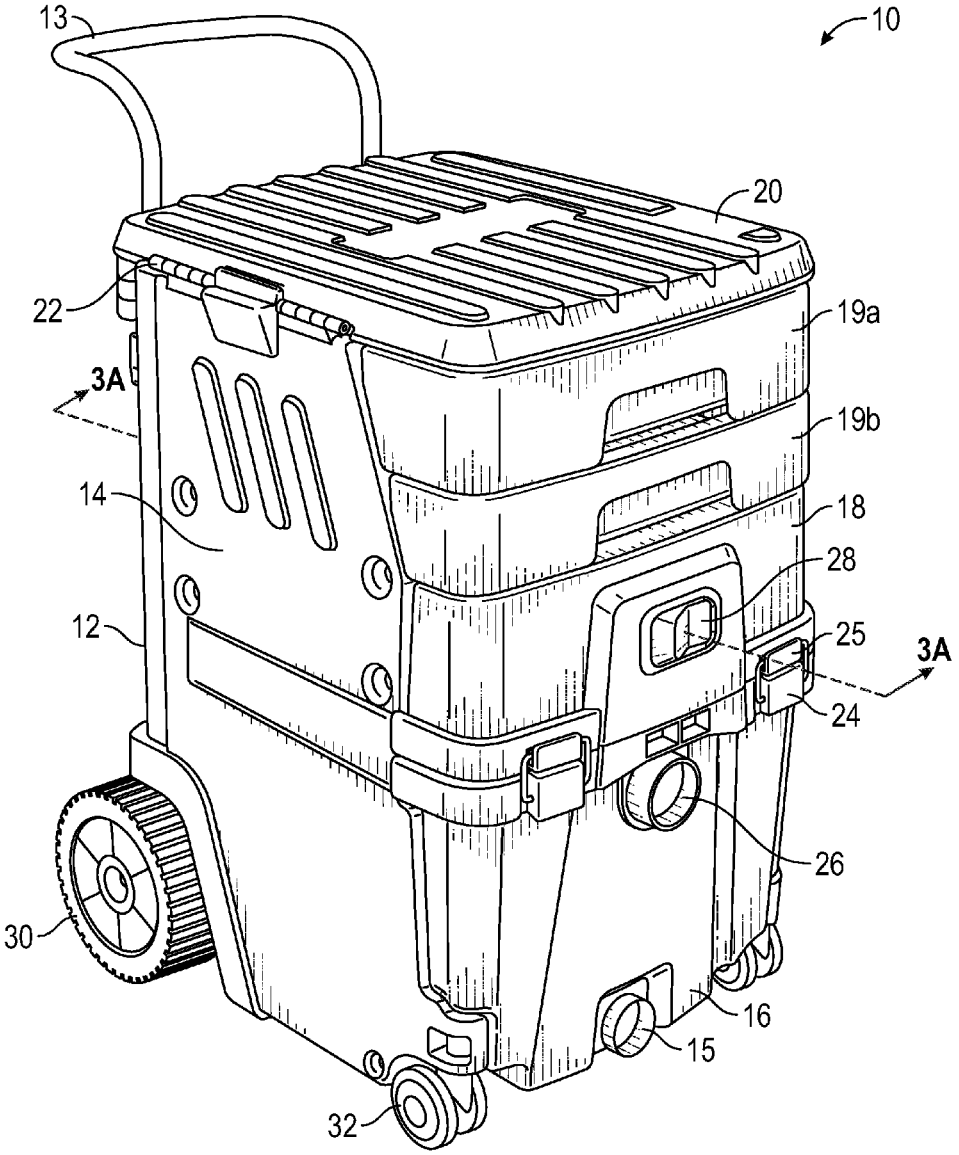
FIG. 1 illustrates a perspective view of an exemplary vacuum cleaner system in accordance with the present disclosure.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in the art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. The term "couple," "coupled," "coupling," "coupler," and like terms are used broadly herein and can include any method or device for securing, binding, bonding, fastening, attaching, joining, inserting therein, forming thereon or therein, communicating, or otherwise associating, for example, mechanically, magnetically, electrically, chemically, directly or indirectly with intermediate elements, one or more pieces of members together and can further include without limitation integrally forming one functional member with another in a unity fashion. The coupling can occur in any direction, including rotationally.

Applicants have created a vacuum cleaner appliance system, which may include many components, such as a housing that may couple with, removably or otherwise, one or more other components of the system. The system may include a vacuum unit or a debris container, one or both of which may be coupled to the housing. For example, the vacuum unit and the container may be coupled to the housing such that an air passageway exists between the two components. The system may include a filter support, which may have a filter coupled thereto. The filter support and/or filter may be coupled, for example, at least partially within the air passageway, such as to allow at least some air traveling through the passageway to pass through the filter. In at least one embodiment, the container may be at least partially removable from the system, such as to facilitate the cleaning or replacement of the container or filter. The housing may be configured to hold two or more components in working relation with one another, such as to bring the container in close proximity to the vacuum unit or, as another example, to allow the container to be coupled with the vacuum unit.

Turning now to the figures, FIG. 1 illustrates a schematic perspective view of an exemplary vacuum appliance system in accordance with the present disclosure. The exemplary system 10 shown is a wet and dry vacuum system, but the present disclosure is not limited to such vacuum appliances. As illustrated in FIG. 1, vacuum appliance system 10 comprises a frame 12 having a handle assembly 13 to which is attached parallel side walls, or panels, 14, and a back panel (not shown) which is in a perpendicular arrangement relative to the two side panels 14. Within the housing formed by the frame 12 and panels 14 is a debris collection container, or drum, 16 and a powerhead, or vacuum unit assembly 18 housing the vacuum motor (M). Atop the vacuum unit assembly 18 are one or more accessory drawers, 19*a* and 19*b*, which slidably engage the side panels 14 and which can be used for storage of tools or vacuum accessory such as hose nozzles and even the vacuum hose itself when not in use. Atop these components is a lid 20 which is hingably attached to one of the side panels 14 via a pivot pin 22 or a similar hinging means, as shown, or alternatively is attached hingably attached to the back panel of the system 10. The system 10 further comprises a plurality of wheels 30 and/or casters 32 to allow easy movement of the system by the user. While the system is illustrated with two rear wheels 30 and two front casters 32, it will be understood that the system may use all casters, or all wheels, as appropriate. The debris collection drum 16, which includes a filter support system as will be described in more detail herein, comprises an air inlet 26 on its front face, extending into the interior of the drum itself, as well as an optionally-included drain and drain cap assembly 15 for ease of removal of liquid debris from the drum, such as via a wet/dry vacuum pump assembly or the like. The air inlet 26 of drum 16 allows for air and/or debris to enter the drum, for example through a flexible vacuum hose or hose wand (not shown for purpose of clarity). The vacuum unit assembly 18 may include operating elements of the vacuum system 10 such as, for example, and without limitation, a motor (M), vacuum impeller, power actuating switch 28, and other elements, such as controls. The vacuum unit assembly 18 may further, optionally include a vacuum inlet and vacuum outlet (not shown), such as for example to allow air (and debris) to pass into or out of the unit 18 during operation of the vacuum. For example, air may pass through a vacuum hose (not shown) attached to air inlet 26 in drum assembly 16, into the and through the vacuum assembly 18, and out of the outlet, such as when operated in a vacuum mode. It will be understood by those of skill in the art that a vacuum hose may optionally be attached to the outlet of the assembly for use as a blower, if desired. Collection drum 16 also comprises one or more securement means 24, for example, latches, hasps, clips, or other securement means, suitable for holding the container in a desired place or manner and mating the 16 in an upward, sealed position with the vacuum unit assembly 18 via latch receiving means formed in or attached to the lower front face of the vacuum assembly 18, as will be described in more detail herein.

As described above, the vacuum appliance system 10 preferably includes a frame or housing 12, such as, for example, a frame or casing, for housing one or more components of the system 10, such as the drum 16, the vacuum unit assembly 18, and the accessory drawers 19*a*, 19*b*. As another exemplary aspect of the present disclosure, the housing 12 may be a cart, which may have a plurality of wheels 30 and/or castors 32, or any other suitable means for allowing the vacuum system 10 to travel. Handle assembly 13, preferably formed as a part of frame or housing 12, or in the alternative permanently or removably attached to housing 12 via an appropriate holder or other appropriate attachment means, acts to assist the user in moving the vacuum system 10 from place to place, and can accept various additions, such as brake levers to stop the system 10 from rolling as desired, as well as retaining means for holding vacuum accessories or additional vacuum hoses in a storage position.

Figure 2:
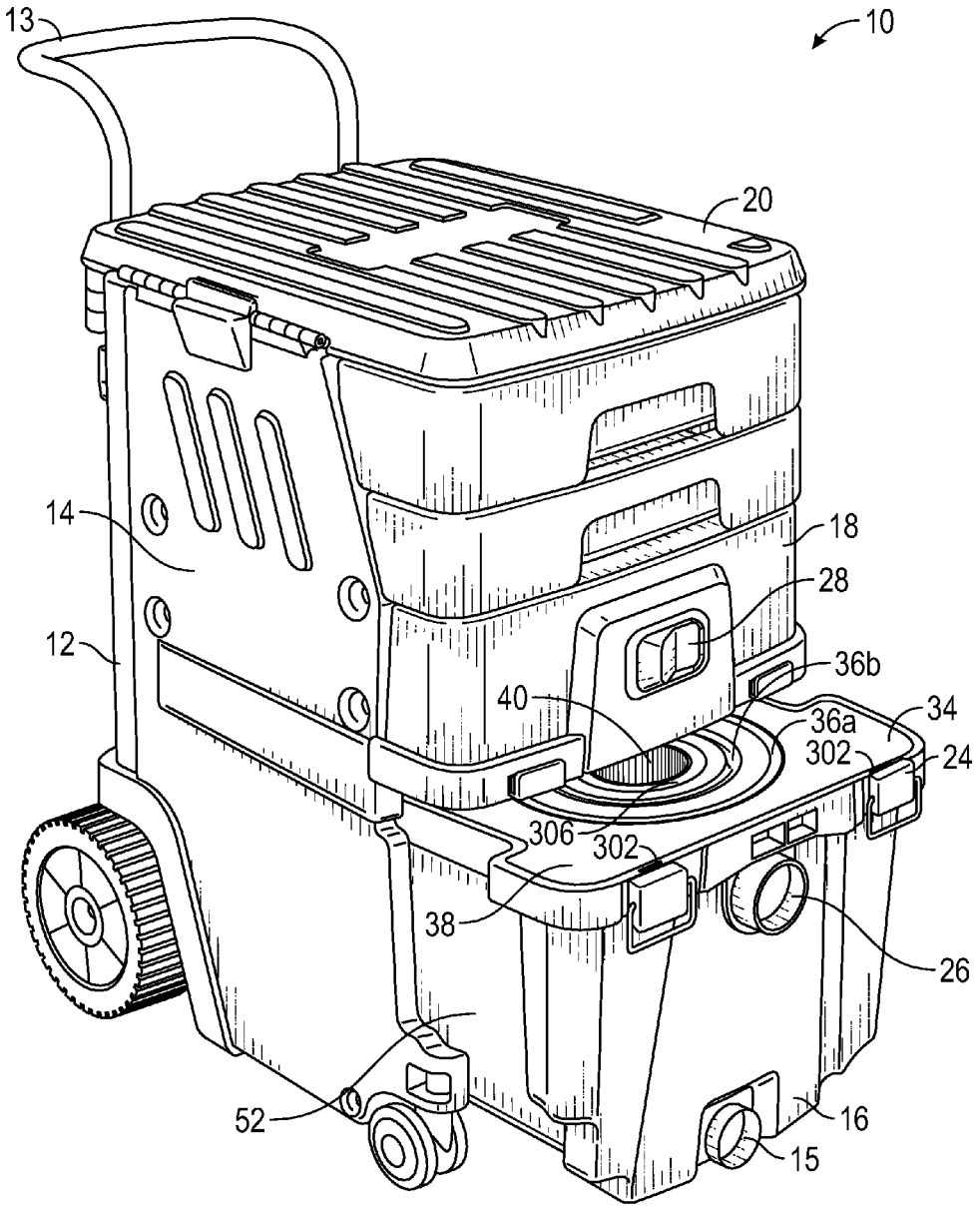
FIG. 2 illustrates a perspective view of the exemplary vacuum cleaner system of FIG. 1, showing the removable drum partially removed.

FIG. 2 illustrates a schematic perspective view of an exemplary vacuum cleaner system of the present disclosure, wherein collection drum 16 is disengaged and partially removed from the vacuum unit assembly 28. In at least one advantageous embodiment, the drum 16 may be removably coupled with the housing 12, via slots or the equivalent formed in the sidewalls 14, as will be further described below, such as to be completely separable from the housing and sidewalls of the system 10, so as to be mobile to aid in cleaning, emptying or, as another example, replacing the container 16 and/or the vacuum filter assembly 40 associated therewith. The drum 16 may have an air outlet 12 such as, for example, an open top or other orifice through which air may flow from the interior of the drum 16 up and through the vacuum assembly 18, when the system 10 is in operation. The air outlet 12 may be unobstructed or further defined, such as for example by a filter support assembly 34 or other device. The support assembly 34, as shown in the figure and as will be described in more detail below, may comprise one or more filters, such as filter 40, which may be suspended, for example to hang at least partially within container 16, or which may be otherwise positioned or secured either directly to filter support assembly 34, or within drum 16. Further, the support assembly 34 may be coupled to the container 16, such as by hinges, latches, or another device, or the support 34 may simply sit on or within the top of drum 16, for example, as a substantially planar lid which is retained on a lip or edge 59 at least partially circumscribing the interior region of the drum 16, such that the support assembly 34 is substantially flush with the top edges of the drum 16, recessed within the container, or which optionally may also protrude from collection drum 16. The support assembly 34 or a portion thereof may further form a seal with the drum 16, in which case the assembly 34 may further include one or more appropriately sized and shaped gasket or other sealing means 36*a*, 36*b*, such as to direct air leaving the container through filter 40. These gaskets, or sealing means, 36*a*, 36*b* will engage and seal onto matching rings on the vacuum powerhead within vacuum unit assembly 18, thus forming a vacuum seal.

As indicated above, the support assembly 34 and/or filter assembly 40 associated therewith may further include one or more sealing devices 36*a*, 36*b*, such as on the top face of the support assembly 34. The sealing devices 36*a*, 36*b* may be gaskets or other seals adapted to sealingly engage, for example, the powerhead of vacuum unit 18 when the container is coupled or matingly engaged to the vacuum unit 18 or installed within the housing 12. In accordance with one aspect of the present disclosure, the sealing devices are two gasket assemblies, primary gasket 36*a* and secondary gasket 36*b*, which act to seal the support assembly 34 which comprises the vacuum filter assembly 40, and the associated drum 16, to the powerhead of vacuum unit 18. Preferably, these gaskets 36*a*, 36*b* are installed in a spaced-apart manner within the top surface 38 of support assembly 34 so that they are visible to the user when the drum 16 is removed from the housing 12 such that they may be easily inspected for damage and replaced as necessary.

Figure 3A:
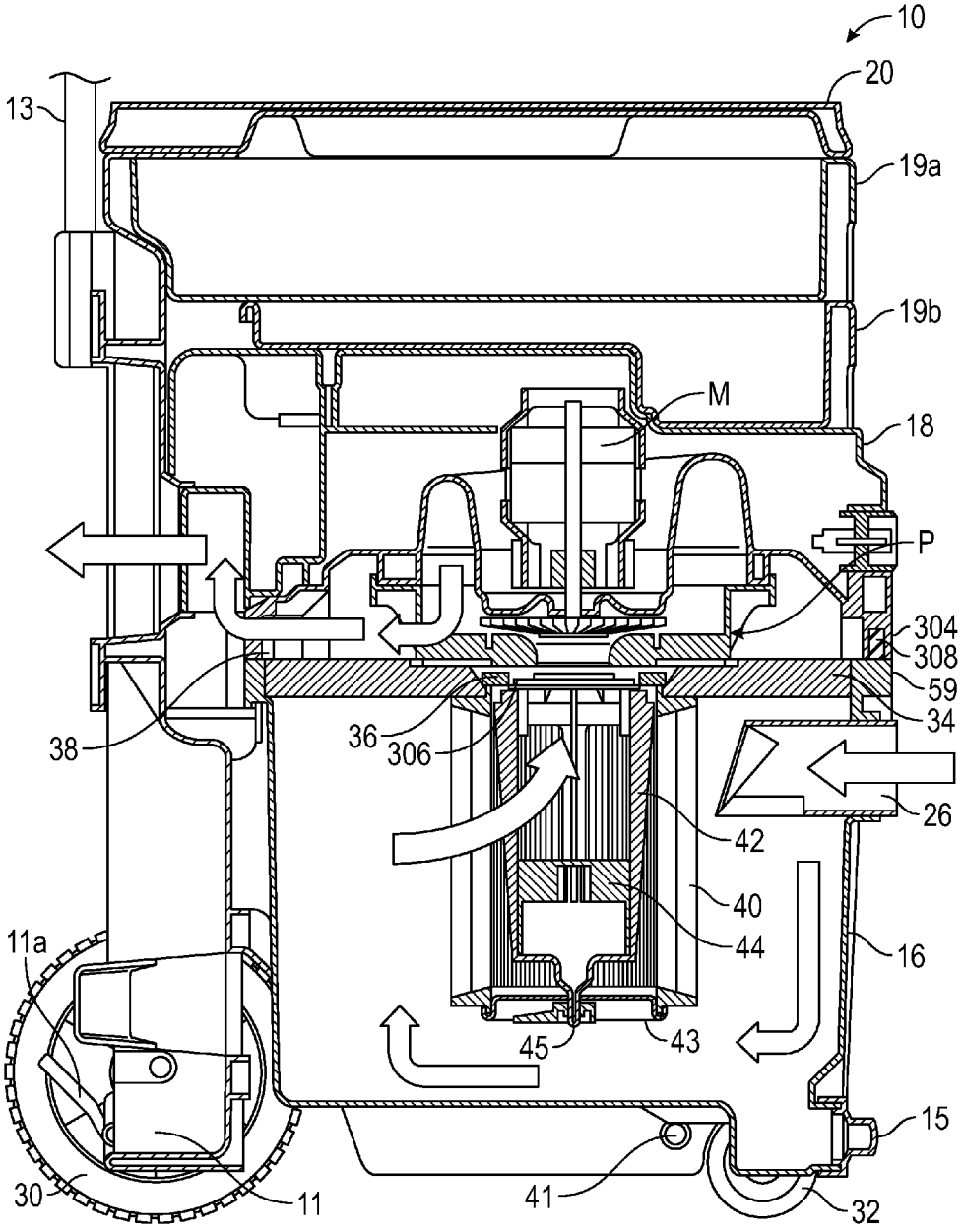
FIG. 3A illustrates a cross-sectional view of the exemplary vacuum cleaner system of FIG. 1, taken along line 3A-3A.
Figure 3B:
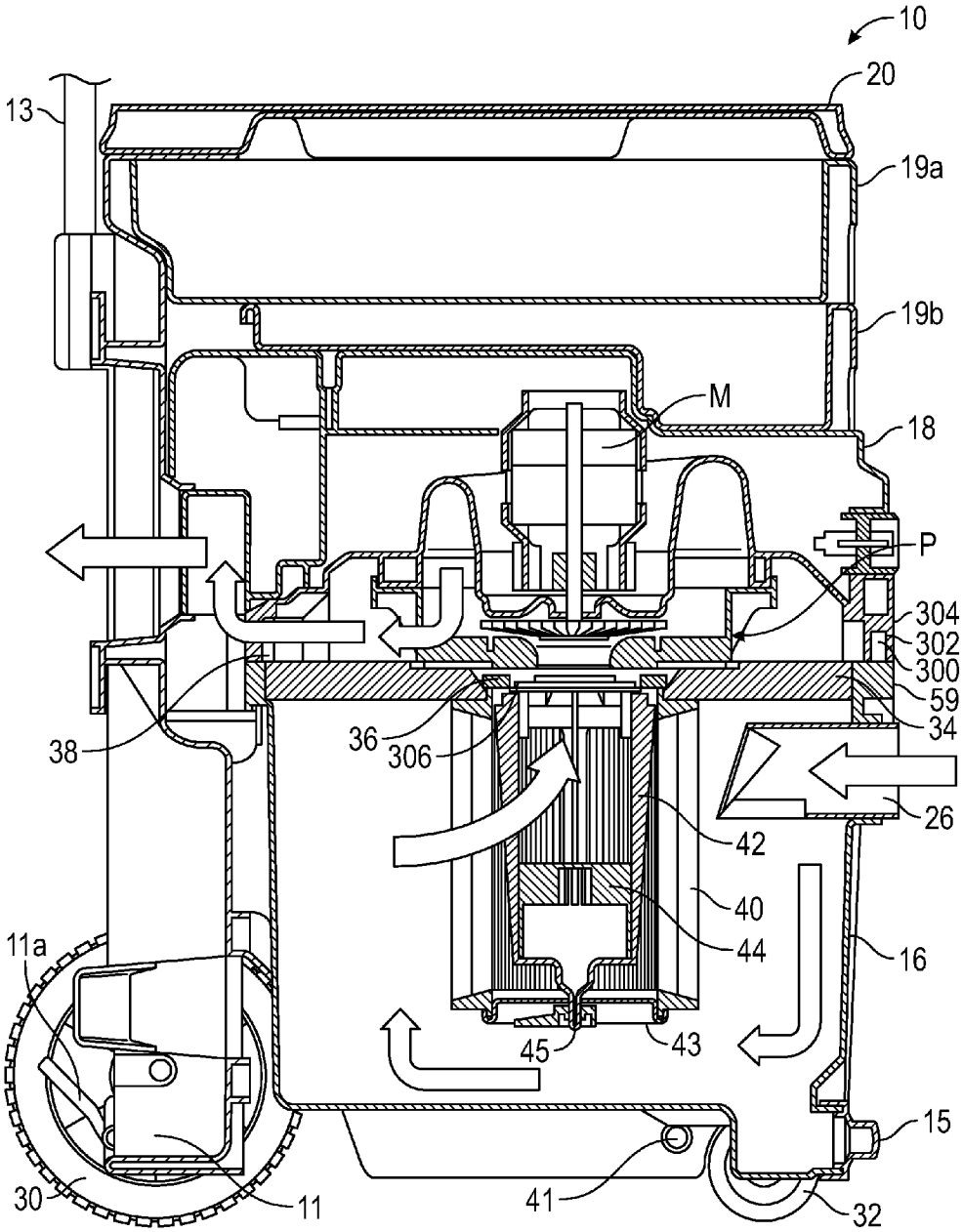
FIG. 3B illustrates an alternative cross-sectional view of the exemplary vacuum cleaner system of FIG. 1, taken along line 3A-3A.

FIG. 3 illustrates a cross-sectional view of the exemplary vacuum cleaner system of FIG. 1 having a removable drum 16, taken along line III-III, for purposes of clarity. In accordance with embodiments of the present invention, such as those shown in FIGS. 1 and 2, for example, the vacuum system 10 may further include accessories, such as a vacuum hose, hose wand, and/or one or more vacuuming extensions or other attachments (not shown). One or more of the accessories may be coupled in any order to the air inlet 26 when, for example, an operator desires to use the vacuum system 10 in vacuum mode. As shown by the air-flow arrows in the Figure, upon the vacuum unit being turned on, air and debris or other waste, which may be solid, liquid, or a slurry of solid and liquid debris, flows via vacuum force through the air inlet 26 and into collection drum 16, wherein the debris may be collected inside the container until such time is appropriate to empty the debris from the container. The remaining air, devoid of most debris at this stage, may pass out of the collection drum 16 through filter assembly 40 where any remaining debris may be filtered out of the air, and up through the air outlet 12 in the top face of the support assembly 34. The filtered air may then pass into a vacuum powerhead inlet 35 of the vacuum powerhead P within vacuum housing 18, generally to then be exhausted or otherwise routed, for example, into the external environment through vacuum outlet 39 formed in the rear panel 14' of the assembly 10.

Also shown with more clarity in FIG. 3 are the details of the filter assembly attached to the bottom face of support assembly 34. As shown therein, the filter assembly comprises at least a filter 40, which is mounted over a filter cage 42 formed with and extending downwardly from the bottom face of the planar support assembly 34. Filter cage 42 may be of any appropriate size or design, including substantially cylindrical or oval, and typically includes a float 44 within the interior region of the cage, as well as a terminal stem which allows the filter 40 to be mounted to the cage 42. The assembly may, but not necessarily, further include a filter plate 43 and associated filter cap screw 45 for threadably securing the filter to the filter cage, although the filter securement mechanism may be integral with the bottom face of the filter 40 itself, as appropriate. The assembly may, but not necessarily, further include a float retainer 306 that retains the float 44 within the cage 42. Filter 40 may be of any appropriate material, as desired, including paper, cloth, and a variety of synthetic materials, such as HEPA-type materials, without limitation.

As mentioned above, and with continued reference to FIG. 3, the collection drum 16 is preferably removable from the vacuum unit housing 18 and/or housing 12 of vacuum system 10, for ease in emptying the drum when it is full of debris. In at least one embodiment, the system 10 may include a support system, which may include one or more support means, such as a support device or support slot formed into the inside walls of side panels 14, for example to support and/or guide the drum 16 into and out of housing 12, and simultaneously to bring the drum 16 and associated support assembly 34 into engagement with the powerhead P and powerhead inlet 35 of the vacuum unit within housing 18. A further optional support device formed into or associated with the bottom of the drum 16, or the housing 12, such as a shaft 41 extending between side panels 14, may act as a drum support member to further support the drum 16 while being installed or removed from the system 10 or, as another example, while the drum is engaged with the vacuum unit within vacuum housing 18 via vacuum powerhead inlet 35. The supporting means may cooperate with any portion of the container, such as the bottom, sides, or another desired part of the container. For example, the support system may include or more container support means, such as a roller or shaft 41, or may include a groove, track or, as another example, a slot. The supporting means or devices may exist or act singularly or in combination, and/or they may cooperate with one or more other attributes of the invention, or none. For example, the supports within the track 29 may support a rear portion of the drum 16, while the shaft 41 supports a front portion of the drum 16, when the drum 16 slides into the housing 12. Furthermore, the supporting means or devices, or portions thereof, may be located on the drum 16, on the vacuum unit housing 18, the housing or frame 12, or may be coupled to or formed by these or any other component of the system 10.

Figure 4A:
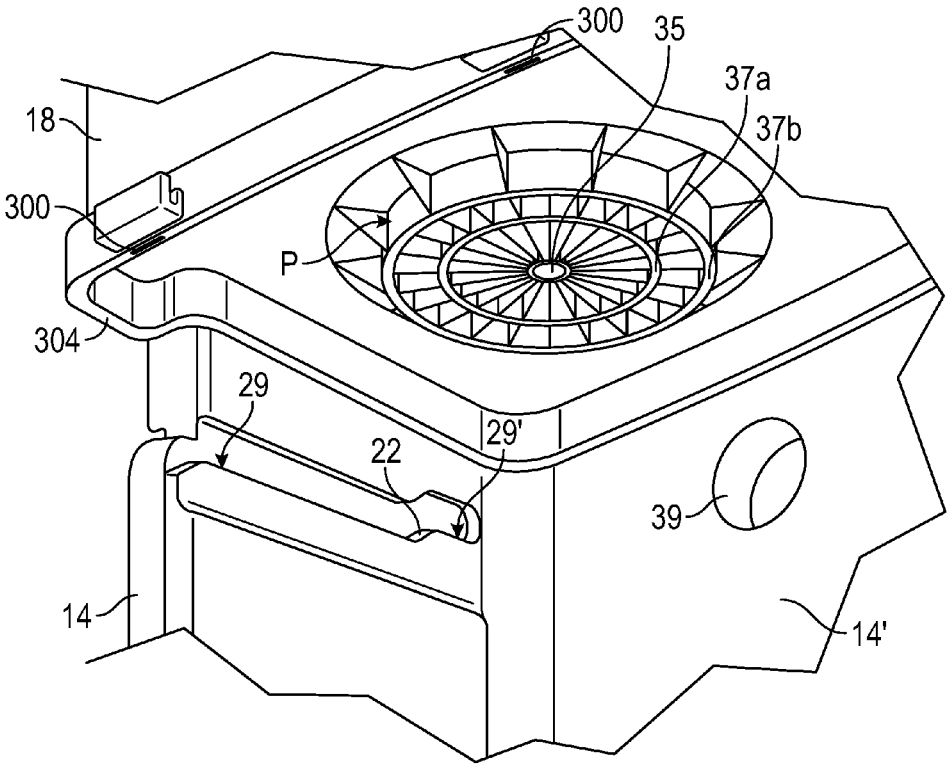
FIG. 4A illustrates a partial perspective view of the interior of the vacuum appliance 10.
Figure 4B:
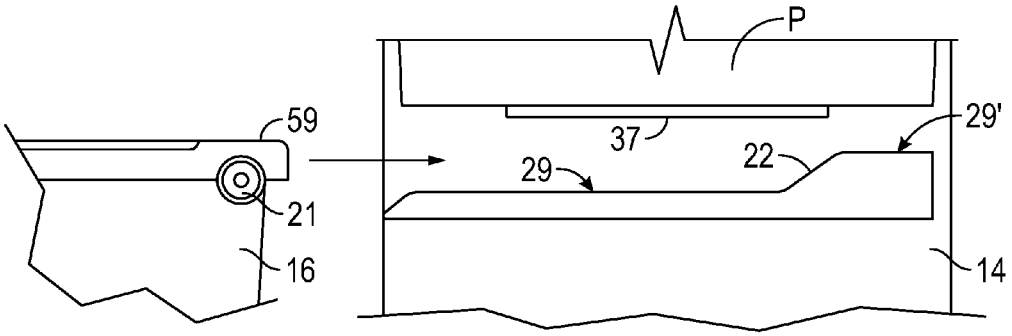
FIG. 4B illustrates a partial cut-away view of an exemplary drum and support system in accordance with the present disclosure being installed into the vacuum assembly 10.

In at least one preferred embodiment of the present invention, such as in FIGS. 1-3, and shown in more particular detail in FIGS. 4A and 4B, the system 10 may further include one or more slots 22, such as slots molded into side panels 14, that slidingly cooperate with one or more supports on the drum 16, such as a glide or roller 21. As illustrated in FIG. 4A, each of the side panels 14 may have a slot 29 molded into the interior face of their wall, at a region proximate the vacuum assembly housing 18. As shown in the figure, the slot extends from the front face of the assembly 10 towards the back panel 14' of the assembly. At the rear portion of the slot 29, the slot is molded to form a ramp 22, so that the tub 16 when inserted into the interior region of the vacuum system 10 is raised upward to sealingly engage the sealing surfaces 37*a*, 37*b* of powerhead P and/or the gasket(s) 308 in the lip 59 of the drum 16 or rim 304 of the vacuum assembly housing 18, discussed below. The support system described above may allow, for example, the drum 16, alone or in combination with the filter support assembly 34, to be slidably installed into or removed from the interior region of vacuum appliance system 10 defined at least in part by the side panels 14 and back panel 14'. Such an embodiment may be advantageous, for example, in that once the container is removed from the system 10, the filter 40 may be uncoupled from either the drum 16 or support assembly 34 as appropriate, while maintaining the assembly 34 in place over the top of drum 16. Any debris falling from the filter 40 during removal of said filter may then fall into the drum itself and not onto the floor or other surroundings. As another nonlimiting example, the support system of the drum assembly described herein may be situated such that when the drum 16 is inserted into the interior region of system 10, the air outlet 50 may be located in close proximity to the sealing surfaces 37*a*, 37*b* on the bottom face of the powerhead P housed within housing 18, such as for example to facilitate a sealing engagement between the drum 16 and the powerhead P of the vacuum unit within vacuum housing assembly 18.

FIG. 4B illustrates a partial cut-away view of an exemplary support and tub engagement system as described above in accordance with the present disclosure. A slot 29, which as described above is preferably molded into the interior walls of panels 14, comprise one or more ramps 22 at the rearward portion of the panel wall, proximate the back panel 14', so as to raise the tub or drum 16 to an elevation proximate the sealing surface of powerhead P by bringing rolling support 21 from a first height in slot 29 to a second, elevated height in terminal slot region 29'. The slots 29, 29' and ramp 22 are preferably situated in the system 10 such that, for example, when the drum 16 is inserted into or removed from the interior region of vacuum appliance system 10, one or more support devices, such as for example roller 21, may cooperate with the slots 29 and 29'. For example, the drum 16 may be pushed or pulled into or out of the interior of system 10 (respectively), thus engaging or disengaging the sealing surfaces 37*a*, 37*b* on the bottom of powerhead P with the sealing means 36*a*, 36*b* on the top face of support assembly 34, and/or the gasket(s) 308 in the lip 59 of the drum 16 or rim 304 of the vacuum assembly housing 18, discussed below, wherein the roller 21 may contact the slot 29, such as to roll along the slot 29. When the drum 16 is being installed into the interior of system 10, the roller 21 may roll along slot 29 and then up ramp 22 to the terminal slot region 29', which may, for example, bring the top surface of drum 16 in close proximity to the bottom sealing surfaces of the powerhead, P. In at least one embodiment, a filter support assembly 34, which may have one or more sealing devices 36*a*, 36*b* as described above, may be proximate to the top of drum 16 (e.g. FIG. 2, FIG. 5). In such an embodiment, for example, the ramp 22 may cause a sealing device 36*a*, 36*b* to directly contact a sealing surface 37*a*, 37*b* on the bottom of the powerunit P in vacuum unit assembly 18 and/or the gasket(s) 308 in the lip 59 of the drum 16 or rim 304 of the vacuum assembly housing 18, discussed below. Thereafter, an operator of the system 10 may couple the drum 16 to the vacuum unit assembly 18, such as by latching the two components together using one or more latches 24 (e.g. FIG. 1). This coupling will bring the top surface of the drum 16 and/or the filter support assembly 34 into closer proximity to the powerhead at the bottom face of vacuum unit assembly 18, so as to cause the sealing means 36*a*, 36*b* to compress, forming a seal between drum 16 and the powerhead P.

As best shown in FIGS. 2 and 4A, the system 10 may further include one or more sets of tabs 300 and recesses 302 to lock the drum 16 to the vacuum unit assembly 18, with the latches 24 secured, thereby allowing the drum 16 to resist being pulled away from the vacuum unit 18 when the operator tugs on the hose. In one embodiment, a lip 59 of the drum 16 includes one or more recesses 302 (best shown in FIG. 2) which rise to surround one or more tabs 300 protruding from a rim 304 of the vacuum unit assembly 18 (best shown in FIG. 4A) when the latches 24 are secured. In an alternative embodiment, these are reversed, such that the lip 59 of the drum 16 includes one or more tabs 300 which rise to fit within one or more recesses 302 in the rim 304 of the vacuum unit assembly 18 (best shown in FIG. 4A) when the latches 24 are secured. The rim 304 of the vacuum unit assembly 18 and/or the lip 59 of the drum 16 may also include a gasket 308 to seal one to the other.

Figure 6:
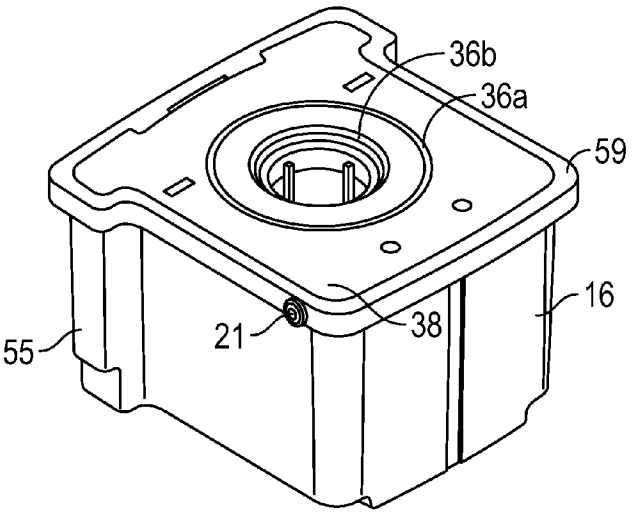
FIG. 6 illustrates a schematic perspective view of the assembly of FIG. 5 in combination.
Figure 5:
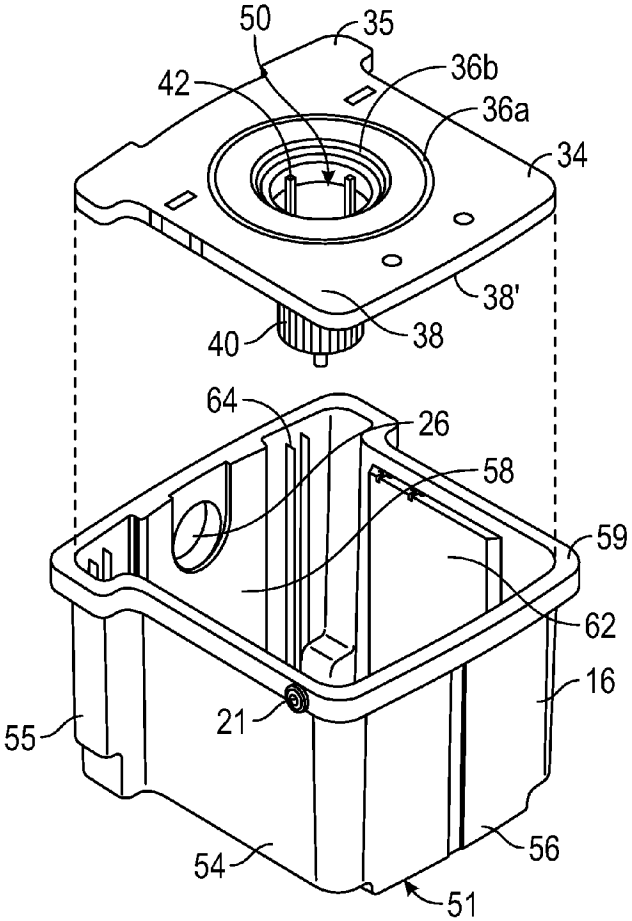
FIG. 5 illustrates an exploded perspective view of an exemplary filter support system and the associated removable drum in accordance with the present disclosure.

FIGS. 5 and 6 will be discussed simultaneously. FIG. 5 illustrates an exploded perspective view of an exemplary filter support assembly 34 having a filter assembly 40 attached thereto and extending downwardly from the bottom face (opposite top face 38) of the assembly 34. As described in reference to FIG. 3, above, the filter assembly is preferably just a filter 40 removably attached to the bottom face of support assembly 34, although it may optionally include other filter components, such as a filter cage, optional filter plate, and the like, as desired. Also shown in FIG. 5 is a perspective view of the debris collection drum 16, which comprises opposite and substantially parallel sides 52 and 54, opposite and substantially parallel front face 58 and back face 56, and bottom 51, such that in combination these components define the interior space 60 of drum 16. Surrounding at least a portion, and preferably the entirety of, the top edge of the drum 16 is a lip 59 which extends outwardly from the walls of the drum. The interior region of the drum may also include one or more interior supports, such as side support 62 and font support 64, for supporting filter support assembly 34 when it is inserted onto the top of the drum 16. In accordance with the present disclosure, while drum 16 is illustrated as being generally rectangular in shape, front and back faces 56 and 58 may be of any appropriate shape, e.g., they may be rounded, as long as sides 52 and 54 are substantially planar and parallel for purposes of support and engagement with the interior region of vacuum system 10. Additionally, regardless of the overall shape of drum 16, it is preferably that the top profile of drum 16 is configured and shaped such that the support assembly 34 may be coupled thereto in a manner that is substantially sealed. In accordance with at least one embodiment, the top of the container 16 may be commensurate in shape with the bottom face of support assembly 34 and/or may comprise one or more recesses (not shown), for example a recess for receiving the support assembly 34. The support assembly 34, in cooperation with the container 16, preferably acts to suspend a vacuum filter 40 at or below the bottom face of 38' of assembly 34, and at least partially within drum 16. A seal may be formed, for example, between the bottom face 38' and a recess or the interior drum supports 62, 64, such as to define at least a portion of the air outlet 50. As illustrated in FIG. 3, during operation of the vacuum system 10, any air leaving the drum 16 may be routed through the filter 40 and out of the top of the drum 16 and/or support assembly 34 such as, for example, to travel into the vacuum inlet 35 when the drum 16 is coupled to the vacuum unit assembly 18 and the system 10 is operated in vacuum mode.

FIG. 6 illustrates a perspective view of the drum 16 for receiving debris during vacuum appliance operation, in coordination with filter support assembly 34, as shown and described in FIG. 5. As discussed above, the support assembly 34 includes a include a shaped surface having a top and bottom face 38 and 38', respectively, and wherein the surface further has an opening 50 or other appropriate means for joining a filter 40 therewith, as discussed in detail above.

Figure 7:
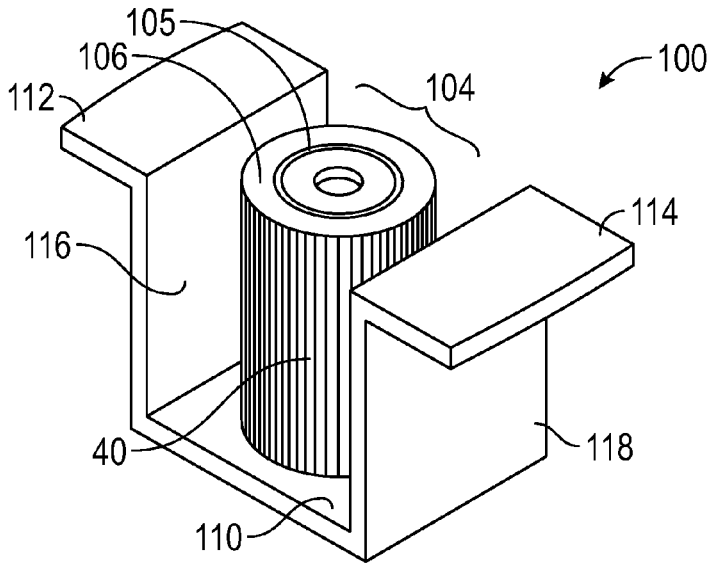
FIG. 7 illustrates a perspective view of an alternative filter support system in accordance with the present disclosure.
Figure 8:
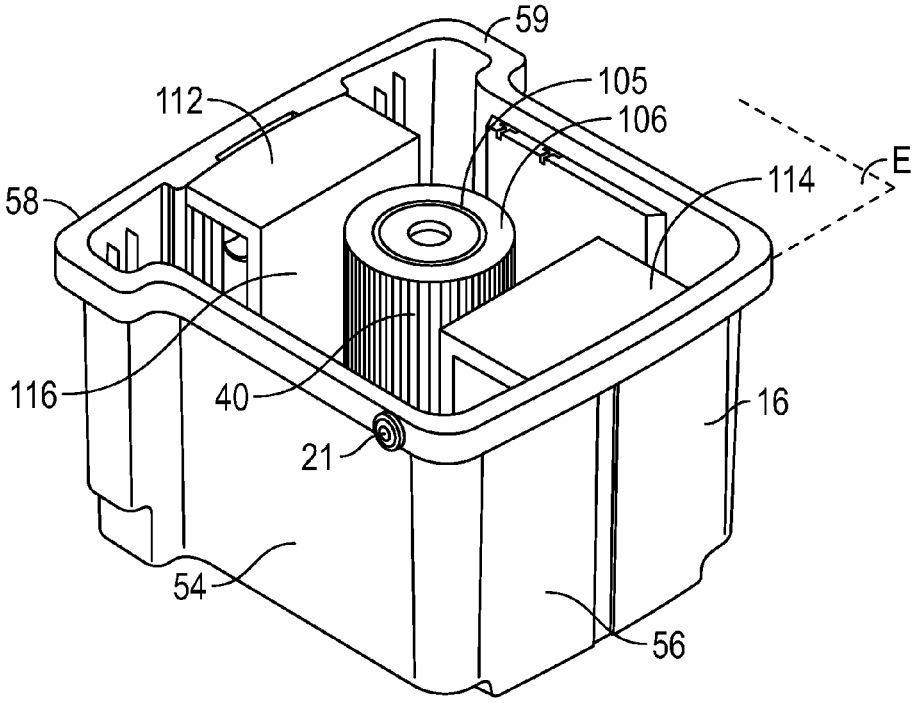
FIG. 8 illustrates a perspective view of the filter support system of FIG. 7 in association with an exemplary vacuum appliance container.

FIG. 7 illustrates a perspective view of an alternative filter support assembly 100 of the present disclosure, comprising a filter assembly 104 and a filter sealing means 105 having gaskets 106 or similar sealing devices as part of the sealing plate on the top of filter 40. The support assembly 100 illustrated therein has a base 110 for holding one or more filters 40 or filter assemblies 104, such filter assemblies 104 comprising a filter 40, a filter cap 105, and one or more gaskets or other appropriate sealing means 106 formed into the top face of such cap, and optionally may also comprise the filter cage and associated components within the interior region of the filter 40, as described in detail above. The base 110 of the support assembly 100 may have one or more support arms 112, 114 in a parallel orientation to base 110, and elevated via walls 116, 118 to a plane substantially the same as the top of the sealing surface on filter assembly 104. The support arms 112, 114 act to allow the support assembly 100 to engage the upper surface of drum 16. For example, as illustrated in FIG. 8, the arms 112, 114 may cooperate with the top of drum 16, such as with a recess or slot (not shown) on the interior of drum 16, such that the filter assembly 104 and the remainder of the base 110 are coupled at least partially inside drum 16. In such an embodiment, for example, the filter 40 may include one or more sealing means 105, such as gaskets, which may sealingly engage the sealing surfaces 37*a*, 37*b* of powerhead P within vacuum assembly unit 18 or another component of the system 10 illustrated in FIG. 1. While support assembly 100 is shown in FIG. 8 to be associated with drum 16 in a front-to-back orientation, it will be understood that assembly 100 may also be oriented in a side-to-side orientation, e.g., arms 112 and 114 may find support and extend from side wall 52 to side wall 54, versus from front wall 58 to back wall 56. Additionally, similar to assemblies described above, filter support assembly 100 may be coupled at or below the top edge or plane (E) of the drum 16, such that at least a portion of the filter 40 or filter assembly 104 is disposed inside the drum 16 and the top surface of the assembly 100 aligns with, and does not extend above, the top edge or plane of the drum.

Figure 9A:
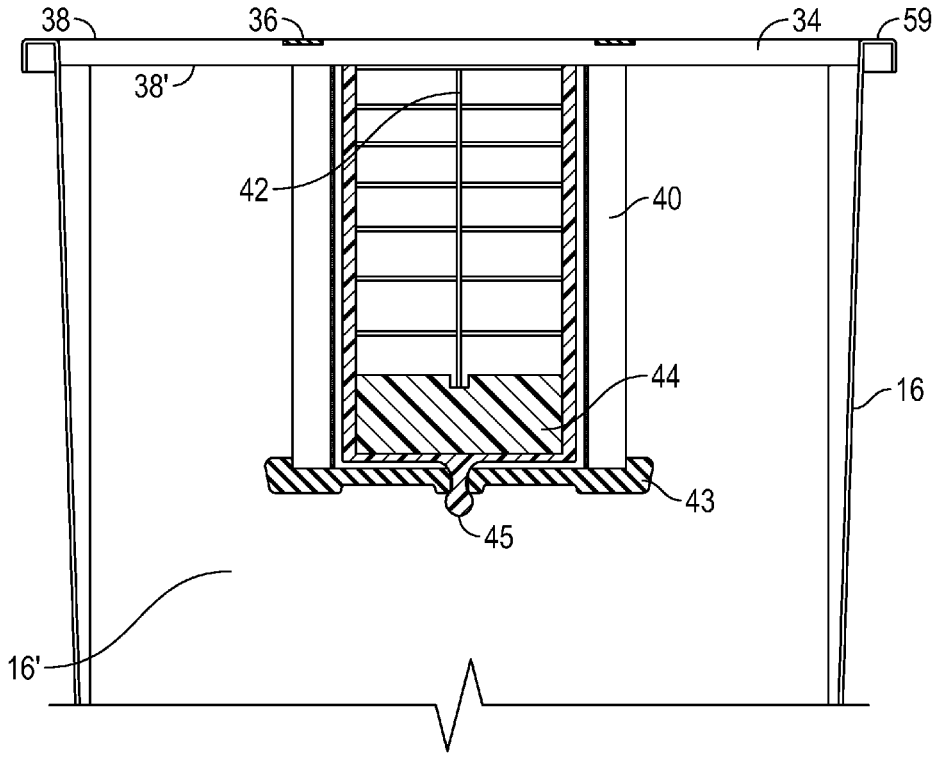
FIG. 9A illustrates a cross-sectional view of an exemplary filter and drum assembly of the present disclosure.

FIG. 9A illustrates a cross-sectional view of an exemplary tub 16 and filter support assembly 34 in coordination with each other, showing how the filter lid/support assembly 34 coordinates with the tub 16 of the wet/dry vacuum appliance 10 in standard operation, and further illustrating details of the filter assembly which comprises filter 40, a filter cage 42 and associated cage stem 45, float 44, and further comprising an optional filter cap or plate 43, which may be made of a hard, rigid material or a soft, flexible material, as appropriate. As shown in the Figure, the top surface 38 of support assembly 34 is substantially in the same plane as the top surface of the lip 59 of tub 16. Similarly, this figure serves to show how the filter assembly extends downward from the bottom face 38' of assembly 34 into the interior region 16' of debris collection drum 16.

Figure 9B:
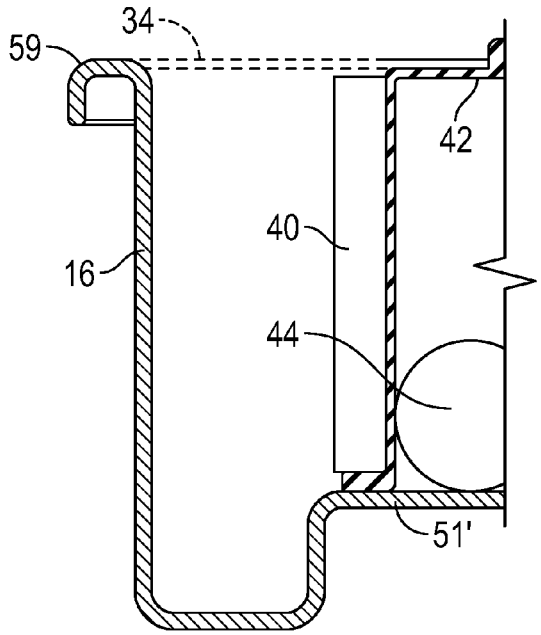
FIG. 9B illustrates a partial cross-sectional view of an alternative arrangement of a filter and drum assembly in accordance with aspects of the present disclosure.
Figure 9C:
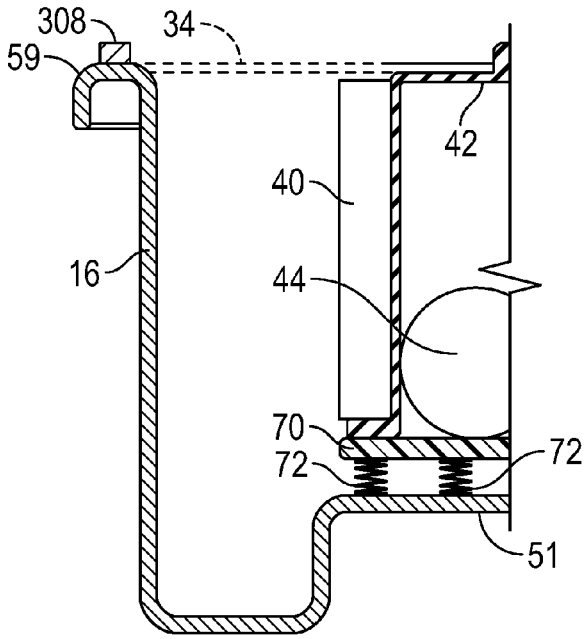
FIG. 9C illustrates a partial cross-sectional view of a further alternative arrangement of a filter and drum assembly incorporating a spring biasing mechanism, in accordance with aspects of the present disclosure.

FIGS. 9B and 9C illustrate alternative arrangements of the filter assembly within tub 16 which are suitable in accordance with aspects of the present disclosure. In these embodiments rather than the filter assembly being attached to a separate support assembly, it is mounted on the bottom surface of the collection tub 16. In FIG. 9B, a central portion 51' of the bottom 51 of the tub 16 is formed to be raised upward into the interior of the tub a height appropriate to allow the top portion of the filter assembly to sealingly engage with the sealing surface of the powerhead P (not shown). An optional sealing support assembly 34 (shown in hashed lines) may be included as appropriate, should the user desire to further separate the debris collected within the collection drum from the lower surface of the powerhead. In FIG. 9C, a drum arrangement similar to that shown in FIG. 9B is formed, having a central raised portion 51'. However, in this embodiment, intermediate between the filter assembly comprising filter 40, filter cage 42, and float 44, is a surface 70 upon which the filter assembly is attached. Between surface 70 and the central region 51' of the bottom of drum 16 is one or more spring biasing means 72 (such as a spring or the equivalent), which act to bias the filter assembly upward and into sealing engagement with the sealing surface on the bottom surface of the powerhead P (not shown) when the collection drum is brought into alignment with the powerhead and vacuum motor assembly 18. This arrangement, similar to that shown in FIG. 9B, allows the use of a planar, sealing support assembly 34 to be optional, as the biasing means 72 forms a strong, sealing contact surface between the top surface of the filter assembly and the bottom, sealing surface of the powerhead P.

Figure 10A:
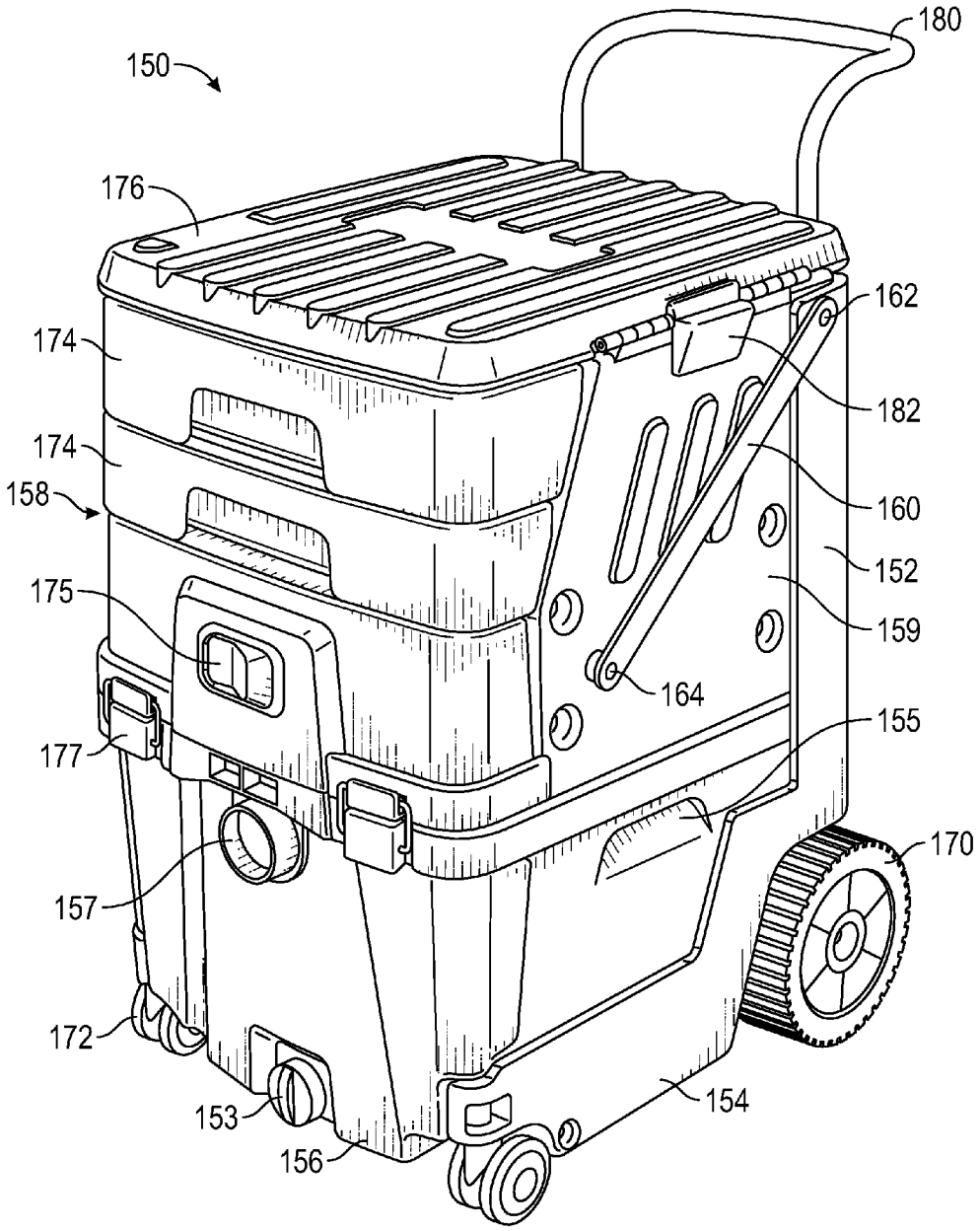
FIG. 10A illustrates an alternative assembly in accordance with the present disclosure.
Figure 10B:
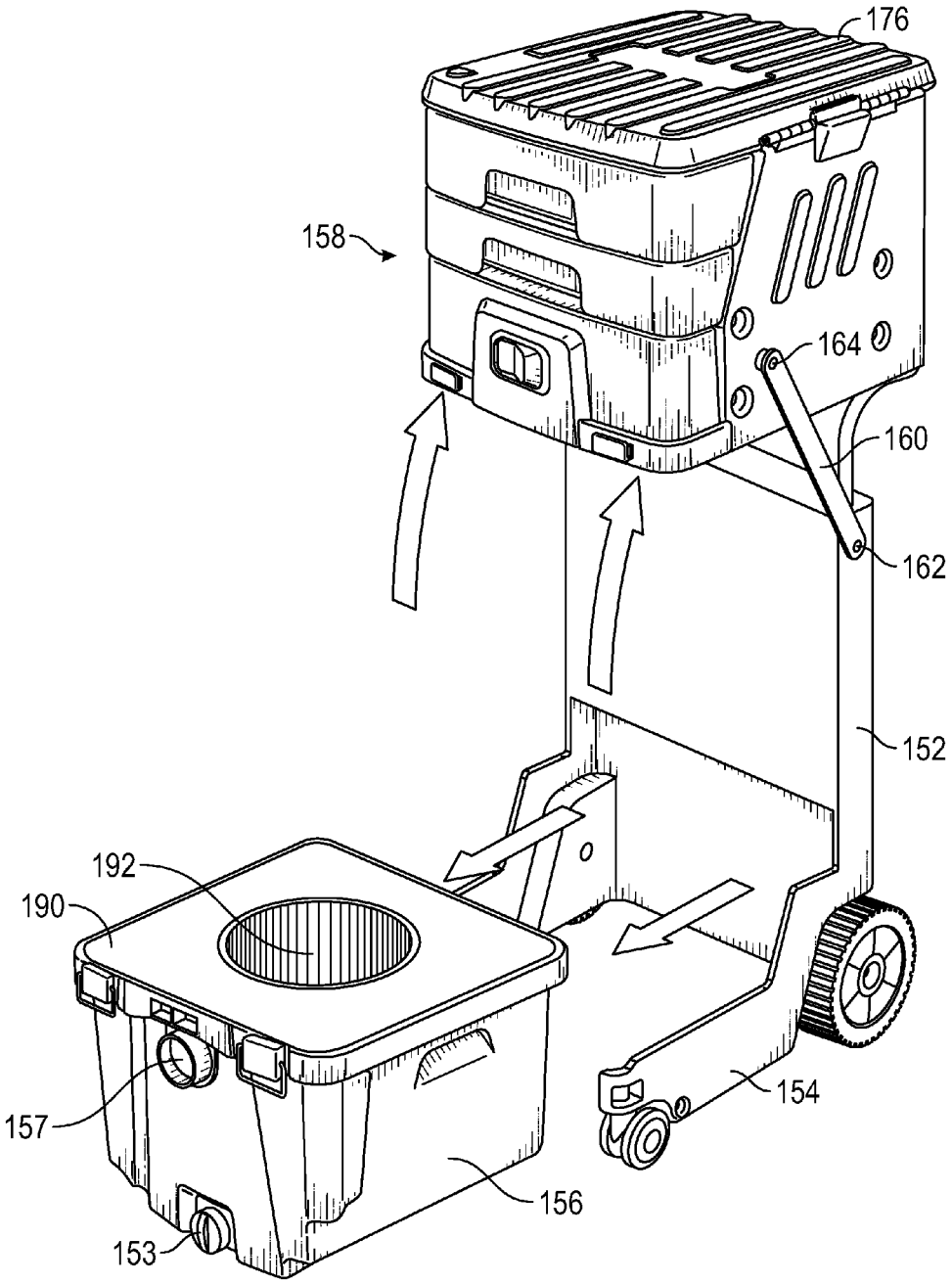
FIG. 10B illustrates the alternative arrangement of FIG. 10A with the powerhead assembly pivoted upward and the collection drum pulled out.
Figure 11:
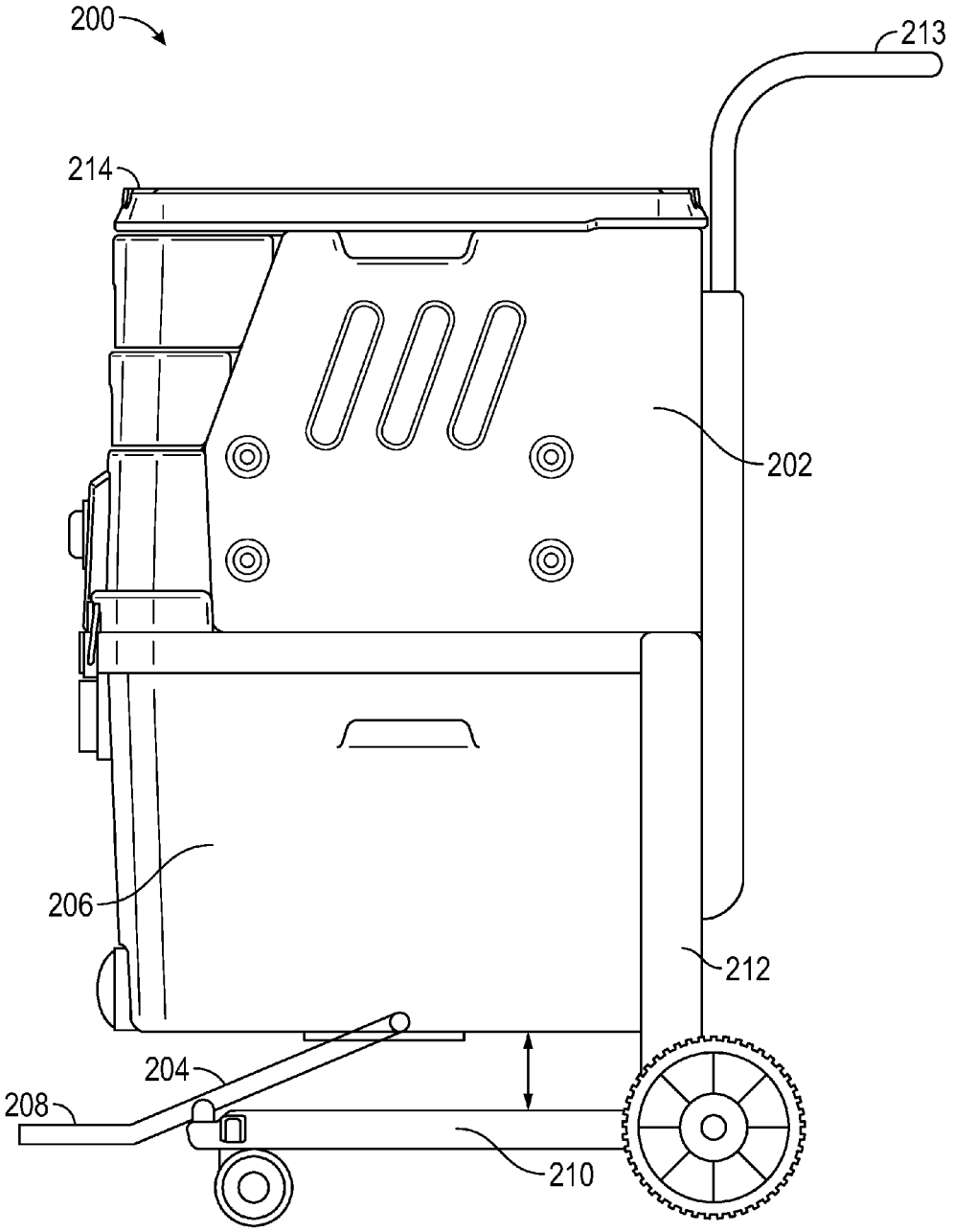
FIG. 11 illustrates a further alternative vacuum collection drum and powerhead sealing assembly in accordance with the present disclosure.

FIGS. 10 and 11 illustrate alternative approaches to methods of removing and emptying a debris collection drum from a wet/dry vacuum appliance. In FIGS. 10A and 10B, an embodiment employing a pivoting vacuum powerhead 158 oriented above the collection drum 156 that pivots up and away from the collection drum using a pivoting linkage assembly 160 for ease in the drum's removal is shown. The use of this particular pivoting design allows for the filter assembly to be optionally installed directly to the powerhead 158, as many current wet/dry vacuum assemblies are. Similar to the vacuum assembly 10 described above, this adapted to be able to fully remove and reinstall the debris collection drum 156 from the assembly itself without having to remove the vacuum powerhead and separately remove the filter assembly in order to prevent debris from the filter falling to the floor. Rather, the aspect shown in FIGS. 10A and 10B would allow the powerhead assembly 158 to be raised via the pivoting linkage to a position above and still over the drum, wherein the filter could be removed from the powerhead for cleaning, with any residual debris or dirt coming off of the filter during its removal falling into the collection drum 156 to be later emptied, rather than it falling to the floor.

Turning to FIG. 10A, the wet/dry vacuum cleaner assembly 150 adapted to effect removal of the debris collection drum 156 from the powerhead assembly 158 comprises at least a vacuum cart frame having a lower base region 154 having rear wheels 170 and front casters 172, and which is substantially parallel to a working surface, an attached or integrally-formed back region 152 oriented perpendicular to the base 154, and a handle assembly 180. A collection drum 156 is insertable on the lower base region of the frame, and an upper powerhead assembly 158 sits directly above and in a sealing engagement (via gaskets or other sealing means) with the collection drum 156. Powerhead assembly 158 includes the vacuum and power assembly for the vacuum appliance, including the motor, located within the lower region of the assembly and linked to the power actuator 175, as well as one or more optional accessory drawers 174 as shown, and a top lid 176 hingedly connected to the upper region of the assembly 158 via hinge 182. The powerhead assembly 158 preferably also includes latching means 177 to retain drum 156 in sealing contact with the powerhead assembly, as well as side panels 159 to protect the interior of the assembly itself. Collection drum 156 comprises at least a vacuum inlet 157, and may optionally include a drain assembly 153 near the bottom front of the drum 156, and optional handles 155. A linking assembly connecting powerhead assembly 158 with the cart frame comprises at least two linking mechanisms, such as linking arms or bars 160, one on each side of the assembly 150, the linking bars 160 being attached at a first end to the back region of the cart frame, and at the opposite second end to the powerhead assembly 158 via attachment means 162 and 164, respectively. The linkage assembly shown in the figures comprises only two linking bars 160, pivotably or hingedly attached at one end to the back frame region 152 and at the opposite end to the vacuum powerhead assembly 158, using any number of appropriate attachment means. However, those of skill in the art will realize that this embodiment may also, alternatively employ more linking bars, such as four or more linking bars, depending upon the strength needed to raise and lower the powerhead assembly. In addition, as the linkage assembly hingedly mounted to the powerhead assembly 158 for an upward, swinging movement of the powerhead as the assembly 158 is reciprocated between the opened and closed positions, the linking assembly may optionally also comprise a reciprocating assist mechanism coupled to the linkage assembly to selectively apply an assist load to the linkage assembly when the powerhead is reciprocated between either the opened and/or closed position. This optional reciprocating assist mechanism may be any appropriate assist, such as an actuator sized to apply an assist load when the weight disposed within the powerhead assembly (such as when numerous items and heavy items are stored in drawers 174) exceeds a predetermined limit.

FIG. 10B illustrates the mechanism of FIG. 10A in operation, with drum 156 pulled out from the cart frame, after powerhead assembly 158 is raised via linking arms 160 to its raised position, allowing the drum to be cleanly removed for emptying. As discussed above, in accordance with this embodiment of the invention, the filter assembly may be directly attached to the powerhead in the standard manner, or as shown in FIG. 10B, may be arranged in a manner such as described in association with the vacuum system 10 described above, including a filter support assembly, or lid, 190 to which the filter assembly 190 may be attached.

In FIG. 11, an alternative approach involving the use of a lever mechanism to raise and lower the collection drum into and out of a sealing position with the Powerhead is illustrated. Vacuum assembly 200 comprises a powerhead assembly 202 with an optional storage lid 214 at its top region, a collection drum 206, a vacuum cart frame 213 having a vertical support 212 and a base support 210 attached and perpendicular to back vertical support 212, and a lever mechanism 204. In this embodiment, the collection drum 206 is raised to the sealing position with the bottom sealing surface of the powerhead 202 using a lever mechanism that is foot operated via foot pedal 208 at the proximate end of the lever mechanism 204. This foot actuated lever 204 has a pivot point that allows the drum 206 to be raised when the pedal 208 is depressed, and lowered when the pedal is depressed again. The drum may be locked into the sealing position once engaged with the bottom face of the powerhead 202, using any number of locking mechanisms, such as a manual latching means attached to the front face of the assembly 200.

Other and further embodiments utilizing one or more aspects of the inventions described above can be devised without departing from the spirit of Applicant's invention. For example, the container may be round, or any shape, and/or the vacuum system may be operated as a blower. Alternatively, a cam or series of cam assemblies may be used to raise the drum manually into a sealing connection with the bottom face of the powerhead. Further, the various methods and embodiments of the vacuum cleaner system can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A wet and dry vacuum cleaner system, comprising:

a housing;

a vacuum unit contained within the housing;

a container for receiving debris, the container slidably received within the housing below the vacuum unit, the container having an air inlet and air outlet;

a filter support removably coupled to the container, the filter support having a filter and the filter support being adapted to situate at least a portion of the filter within the container;

wherein the housing includes tracks within which supports of the container glide as the container is slid within the housing, the tracks include ramps configured to raise a rear portion of the container as the container is slid within the housing;

at least one latch configured to lift a front portion of the container and thereby sealingly couple the container to the vacuum unit.

2. The vacuum cleaner system of claim 1, wherein the container has at least one gasket adapted to sealingly engage the vacuum unit.

3. The vacuum cleaner system of claim 1, wherein the vacuum unit has at least one gasket adapted to sealingly engage the container.

4. The vacuum cleaner system of claim 1, wherein the container is freely mobile upon being decoupled from the housing by releasing the at least one latch.

5. The vacuum cleaner system of claim 1, wherein the container slides within the housing on rollers.

6. The vacuum cleaner system of claim 1, wherein the container slides within the housing on glides.

7. The vacuum cleaner system of claim 1, the filter support further including a float therein and a float retainer configured to retain the float within the filter support.

8. The vacuum cleaner system of claim 1, further including tabs that engage recesses when the container is coupled to the vacuum unit, thereby resisting lateral forces on the container, wherein the tabs extend up from the container into the recesses located within the vacuum unit, when the container is coupled to the vacuum unit.

9. The vacuum cleaner system of claim 1, further including tabs that engage recesses when the container is coupled to the vacuum unit, thereby resisting lateral forces on the container, wherein the tabs extend down from the vacuum unit into the recesses located within the container, when the container is coupled to the vacuum unit.

10. A wet and dry vacuum cleaner system, comprising:

a housing having two side panels;

a vacuum unit coupled between the two side panels of the housing, the vacuum unit having a bottom;

a container removably sealed to the bottom of the vacuum unit, the container having an air inlet and air outlet, the container being slidably received within slots of the two side panels of the housing; wherein the housing includes the slots within which supports of the container glide as the container is slide within housing, the slots include ramps at a rear of the slots, the ramps being configured to raise a rear portion of the container as the container is slid within the housing; and a filter support having a filter, the filter support being removably coupled between an inside of the container and the vacuum unit such that air traveling from the container to the vacuum unit passes through the filter and the filter support being adapted to situate at least a portion of the filter within the container.

11. The vacuum cleaner system of claim 10, wherein the container is slidingly removable from the housing when the container is uncoupled from the vacuum unit.

12. The vacuum cleaner of claim 10, wherein the container further comprises rollers that communicate with the slots.

13. The vacuum cleaner system of claim 10, wherein the slots support and lift a rear portion of the container as the container is slid into the housing and coupled to the vacuum unit.

14. The vacuum cleaner system of claim 10, further including at least one latch at least partially mounted on a front portion of the container which lifts the front portion of the container as the container is slid into the housing and coupled to the vacuum unit.

15. The vacuum cleaner system of claim 10, wherein the side panels of the housing include slots which support a front portion of the container as the container is slid into the housing and coupled to the vacuum unit.

16. The vacuum cleaner system of claim 10, wherein the container has at least one gasket adapted to sealingly engage the vacuum unit.

17. The vacuum cleaner system of claim 10, wherein the vacuum unit has at least one gasket adapted to sealingly engage the container.

18. The vacuum cleaner system of claim 10, further including tabs that extend up from the container to engage recesses in the vacuum unit when the container is coupled to the vacuum unit, thereby resisting lateral forces on the container.

19. The vacuum cleaner system of claim 10, further including tabs that extend down from the vacuum unit to engage recesses in the container when the container is coupled to the vacuum unit, thereby resisting lateral forces on the container.

* * * * *